US005740055A

United States Patent [19]

Iwata

[11] Patent Number: 5,740,055

[45] Date of Patent: Apr. 14, 1998

[54] PROCESS AND APPARATUS FOR PREPARING DATA FOR CUTTING OUT AND EMBROIDERING AN APPLIQUE

[75] Inventor: Susumu Iwata, Ichinomiya, Japan

[73] Assignee: Kabushikikaisha Barudan, Ichinomiya, Japan

[21] Appl. No.: 183,425

[22] Filed: Jan. 19, 1994

[30] Foreign Application Priority Data

Jan. 25, 1993 [JP] Japan ..... 5-029945
Jan. 30, 1993 [JP] Japan ..... 5-034240

[51] Int. Cl.[6] ..... G06F 19/00

[52] U.S. Cl. ..... 364/470.1; 112/121.11; 112/475.19; 112/80.23

[58] Field of Search ..... 364/470.1; 112/121.11, 112/121.12, 456, 457, 99–103, 78, 84, 80.23, 266.1, 475.19, 475.8, 439

[56] References Cited

U.S. PATENT DOCUMENTS 4,365,565 12/1982 Kawai et al. ..... 112/103
4,765,265 8/1988 Brownbill et al. ..... 112/99
5,005,500 4/1991 Kato et al. ..... 364/470

FOREIGN PATENT DOCUMENTS 4026250 12/1992 Germany .
4242702 7/1993 Germany .
5527189 7/1980 Japan .
5994665 5/1984 Japan .

*Primary Examiner*—Roy N. Envall, Jr.
*Assistant Examiner*—Thomas E. Brown
*Attorney, Agent, or Firm*—Cushman, Darby & Cushman IP Group of Pillsbury Madison & Sutro LLP

[57] ABSTRACT

Data on the outline of an applique to be cut out and embroidered are inputted by a digitizer, etc. to a microcomputer only once. Data for cutting out the applique and data for embroidering it are both prepared from the inputted outline data for delivery to a cutting device and an embroidering machine, respectively.

22 Claims, 8 Drawing Sheets

PROCESS AND APPARATUS FOR PREPARING DATA FOR CUTTING OUT AND EMBROIDERING AN APPLIQUE

BACKGROUND OF THE INVENTION

1. Field of the Invention

This invention relates to a process and an apparatus for preparing data for cutting out an applique and embroidering it.

2. Description of Related Art

It has hitherto been usual to prepare separately by separate devices data which are required for controlling a cutting device for cutting out an applique, and data which are required for controlling an embroidering machine. It has been usual that data for cutting out an applique having a desired shape are prepared by a device attached to, or capable of being attached to the cutting device, and are used for cutting out the applique by the cutting device, while data for embroidering the applique are prepared by a device attached, or capable of being attached, to the embroidering machine, and are used for embroidering the applique to another piece of cloth by the machine. The following is a detailed description of the processes which have been employed for preparing the data.

(A) Preparation of Cutout Data:

A pattern 51 having, for example, an L-shaped outline is stuck to the board of a digitizer 50 in the device for preparing cutout data, as shown in FIG. 14(*a*). Then, the corner points C1 to C6 and arc-forming points R1 to R3 which form its L-shaped outline are picked up by a pointing device 52, such as a button cursor, whereby outline data are inputted to the device. The device prepares cutout data for the cutting device from the outline data.

(B) Preparation of Embroidery Data:

(1) The preparation of embroidery data is started by preparing temporary sewing data for positioning the applique on a piece of cloth. The pattern 51 is stuck to the board of a digitizer 53 in the device for preparing embroidery data, as shown in FIG. 14(B). Then, the corner points C1 to C6 and arc-forming points R1 to R3 are picked up by a pointing device 54, whereby the outline data are inputted to the device for preparing embroidery data. The device prepares, from the outline data, the temporary sewing data which enable the embroidering machine to make a series of appropriately pitched temporary stitches.

(2) Fixed sewing data are, then, prepared for fixing the applique to the cloth along the temporary stitches. The corner points C1 to C6 and arc-forming points R1 to R3 are picked up again by the pointing device 54, as shown in FIG. 14(*b*), whereby the outline data are inputted to the device for preparing embroidery data. The device prepares, from the outline data, the fixed sewing data which enable the embroidering machine to make a series of fixed stitches (e.g. E stitches).

(3) Then, satin stitch data are prepared for embroidering the applique fixed to the cloth. The pointing device 54 alternately picks up inner circumferential points I1, I2, . . . forming an inner circumferential line along and inwardly of the L-shaped outline on the pattern, and outer circumferential points O1, O2, . . . forming an outer circumferential line along and outwardly of the L-shaped outline to thereby prepare inner and outer circumferential data for the L-shaped outline. The device for preparing embroidery data prepares, from the inner and outer circumferential data, the satin stitch data which enable the embroidering machine to make a series of appropriately pitched satin stitches.

The preparation of the cutout data and that of the embroidery data have hitherto been carried out separately from each other, as described at (A) and (B) above, but since the work of inputting the outline data for preparing the embroidery data is substantially identical to that for preparing the cutout data, its repetition has been a waste of labor. The waste of labor is extraordinary if it is necessary to cut out and embroider a wide variety of differently shaped appliques each in a small number, such as ones indicating racing numbers, as has recently been often the case.

The separate preparation of the cutout and embroidery data has also called for separate devices including two digitizers 50 and 53, two microcomputers and displays (not shown), etc., and thereby created a great economic burden. Moreover, the installation of those devices has required a large space.

SUMMARY OF THE INVENTION

Under these circumstances, it is an object of this invention to provide a process which enables the efficient preparation of data for cutting out an applique and data for embroidering it by a single or common step of inputting work.

This object is attained by a process which comprises the steps of inputting outline data for an applique only once, preparing data for cutting out the applique from the outline data, and preparing data for embroidering it from the outline data.

The inputting of the outline data is carried out by, for example, using a pointing device and picking up the outline of a pattern attached to a digitizer. It is preferable to pick up a point somewhat ahead of an arbitrarily selected reference point along the outline of the pattern as a starting point, and a point somewhat beyond the reference point as an ending point, when inputting the outline data, so that cutout data may have a starting portion and an ending portion which cross each other.

The inputting of the outline data may alternatively be carried out by employing, for example, an image scanner to read out the outline of the pattern.

The data for embroidering the applique include temporary sewing data for positioning it on a piece of cloth.

The data for embroidering the applique also include fixed sewing data for fixing it to the cloth. The fixed sewing data are, for example, prepared from inner and outer circumferential data which are prepared from the inputted outline data, and which are represented by a line extending along and inwardly of the outline and a line extending along and outwardly of the outline, respectively.

The data for embroidering the applique further include satin stitch data for embroidering it to the cloth. The satin stitch data are, for example, prepared from inner and outer circumferential data which are prepared from the inputted outline data, and which are represented by a line extending along and inwardly of the outline and a line extending along and outwardly of the outline, respectively.

The process may also include the step of storing at least one of the cutout and embroidery data in an external memory.

The process may further include the step of transmitting at least one of the cutout and embroidery data directly to a cutting device or an embroidering machine, as the case may be.

It is another object of this invention to provide an apparatus which can be used in common for preparing both data for cutting out an applique and data for embroidering it, and which is, therefore, less expensive and calls for only a smaller space for installation.

This object is attained by an apparatus which comprises means for inputting outline data on an applique, and means for preparing, from the outline data, both data for cutting out an applique and data for embroidering it.

The means for inputting outline data may, for example, be a digitizer (including a small one called a tablet), an image scanner, a touch panel, a light pen, a mouse, or a tracking ball. The means for preparing data may, for example, be a microcomputer.

The apparatus may also include an external memory for storing at least either of the cutout and embroidery data. The apparatus may further include means for transmitting at least one of the cutout and embroidery data directly to a cutting device or an embroidering machine, as the case may be. The transmitting means may, for example, be a transmission cable or a wireless transmission device.

The process of this invention makes it sufficient to input the outline data on an applique only once, from which both of the cutout and embroidery data can be prepared.

The apparatus of this invention includes only one means for inputting the outline data on an applique, from which both of the cutout and embroidery data can be prepared.

Other and further objects of this invention will become obvious upon an understanding of the illustrative embodiments about to be described or will be indicate in the appended claims, and various advantages not referred to herein will occur to one skilled in the art upon employment of the invention in practice.

DETAILED DESCRIPTION OF THE PREFERRED EMBODIMENTS

Figure 1:
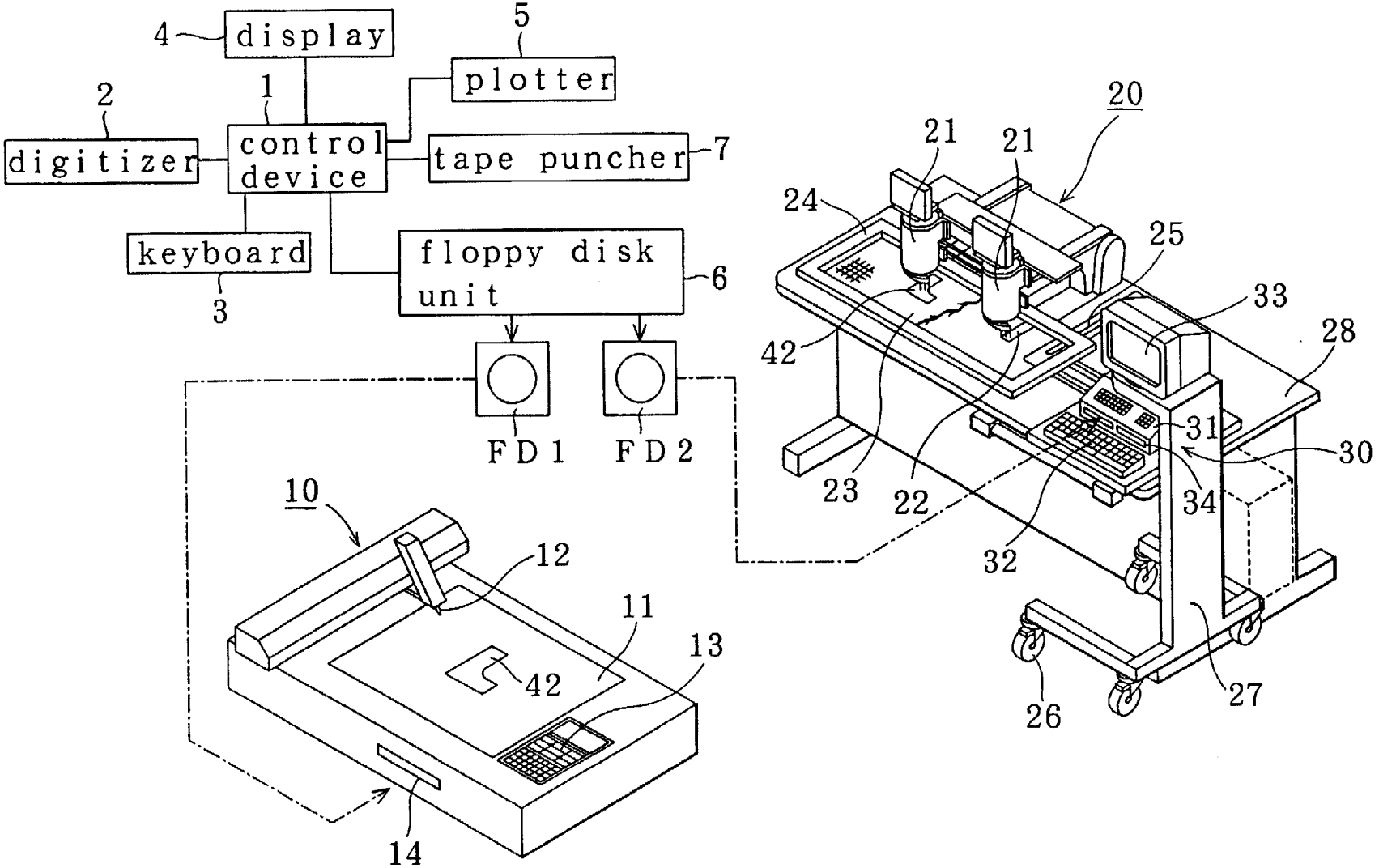
FIG. 1 is a view showing the overall construction of an apparatus embodying this invention.

The invention will now be described more specifically with reference to FIGS. 1 to 13. An apparatus embodying this invention is shown in FIG. 1. The apparatus 100 includes a control device 1 which comprises a microcomputer including a CPU, a ROM, a RAM, a connecting bus and an input-output interface. Connected to the control device 1 are a digitizer 2 and a keyboard 3 which form an input unit, a display 4 which presents information in visual form, an X-Y plotter 5 as a printer, and a floppy disk unit 6 and a tape puncher 7 which form an external memory. The construction of the apparatus 100 as described above is merely illustrative, and therefore, the external memory, for example, may alternatively comprise a hard disk unit (including a removable one), a magnetic tape or card unit, a photomagnetic or photo disk unit, or an IC card unit.

A device 10 for cutting out an applique comprises a panel 11 on which a piece of cloth for forming an applique is set, a cutting blade 12 to be driven in the directions of the X and Y axes, and reciprocatively driven in the direction of the Z axis as well, if required, an operating key 13 and a floppy disk unit 14 as an input unit. The floppy disk unit 14 is fed with a floppy disk FD1 in which cutout data are stored through the floppy disk unit 6.

The cutting blade 12 may be replaced by, for example, a heat cutter which relies upon melting by heat, a laser cutter, or a liquid jet cutter. If any external memory other than a floppy disk unit is used in the apparatus 100 for preparing data, a corresponding memory need be also incorporated in the cutting device 10.

Figure 12:
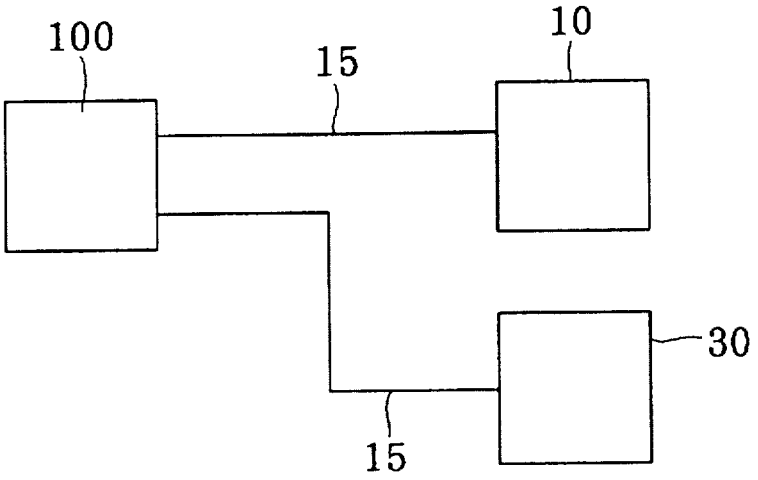
FIG. 12 is a diagram showing a mode of transmitting data from the apparatus of this invention to a cutting device and a device for controlling an embroidering machine.
Figure 13:
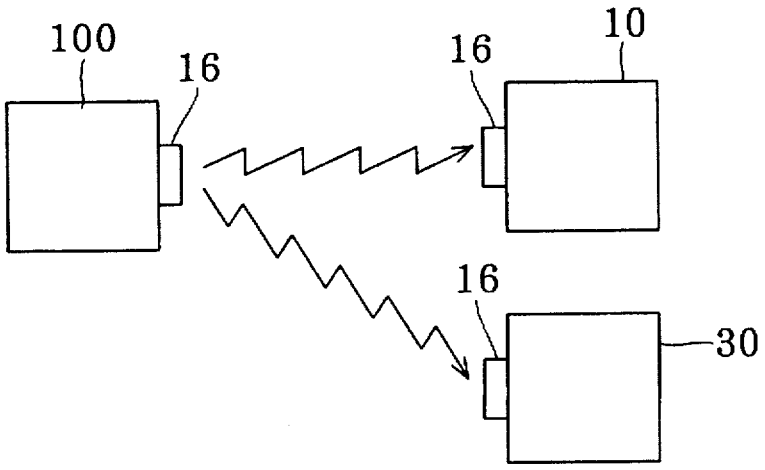
FIG. 13 is a diagram showing a different mode of transmitting data.
Figure 14A:
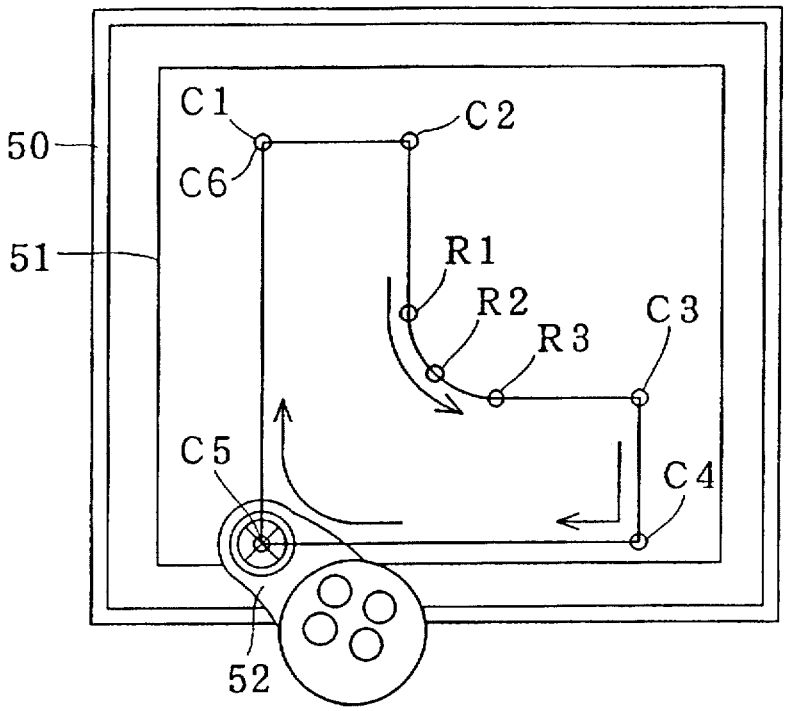
FIG. 14(*a*)and 14 (*b*)are views showing the conventional step of inputting data.
Figure 14B:
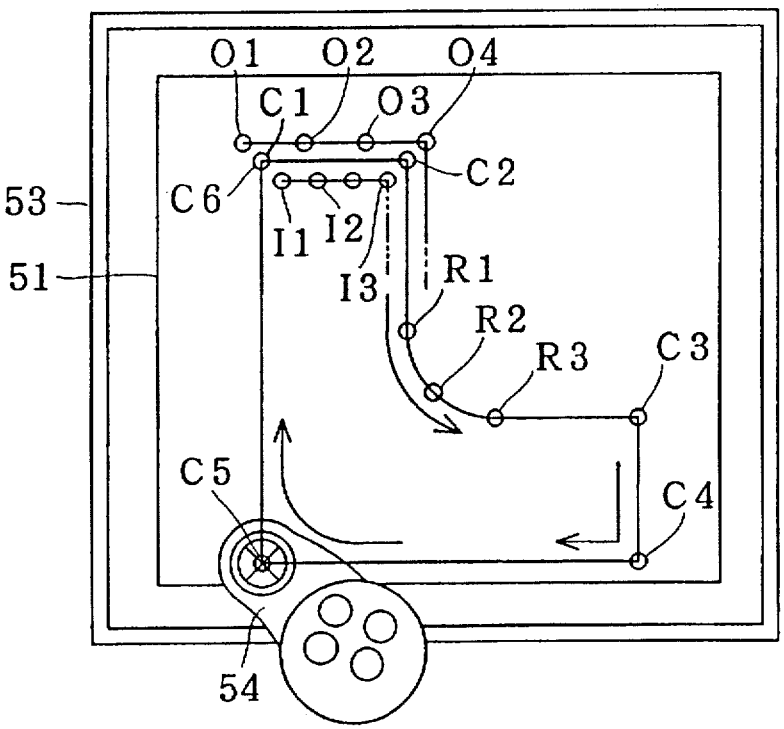

The apparatus 100 can alternatively be connected to the cutting device 10 by a transmission cable 15 as shown in FIG. 12, or by a wireless transmission device 16 as shown in FIG. 13, so that the cutout data prepared by the apparatus 100 may be transmitted directly to the cutting device 10.

A machine 20 for embroidering an applique to another piece of cloth comprises a plurality of embroidery heads 21 each adapted to move up and down a needle carrying a needle thread, a bed 22 containing hooks and bobbins carrying bobbin threads, an embroidery frame 24 across which a piece of cloth 23 is stretched, and a drive unit 25 for the embroidery frame 24. A wagon 27 having castors 26 supports a device 30 for controlling the embroidering machine on a table 28. The machine controlling device 30 includes a control panel 31, a keyboard 32, a display 33 and a floppy disk unit 34 incorporated as an input unit in the control panel 31. The floppy disk unit 34 is fed with a floppy disk FD2 in which embroidery data are stored through the floppy disk unit 6. If any external memory other than a floppy disk unit is used in the apparatus 100, a corresponding memory need be also incorporated in the machine controlling device 30.

The apparatus 100 can alternatively be connected to the machine controlling device 30 by a transmission cable 15 as shown in FIG. 12, or by a wireless transmission device 16 as shown in FIG. 13, so that the embroidery data prepared by the apparatus 100 may be transmitted directly to the machine controlling device 30.

Figure 2:
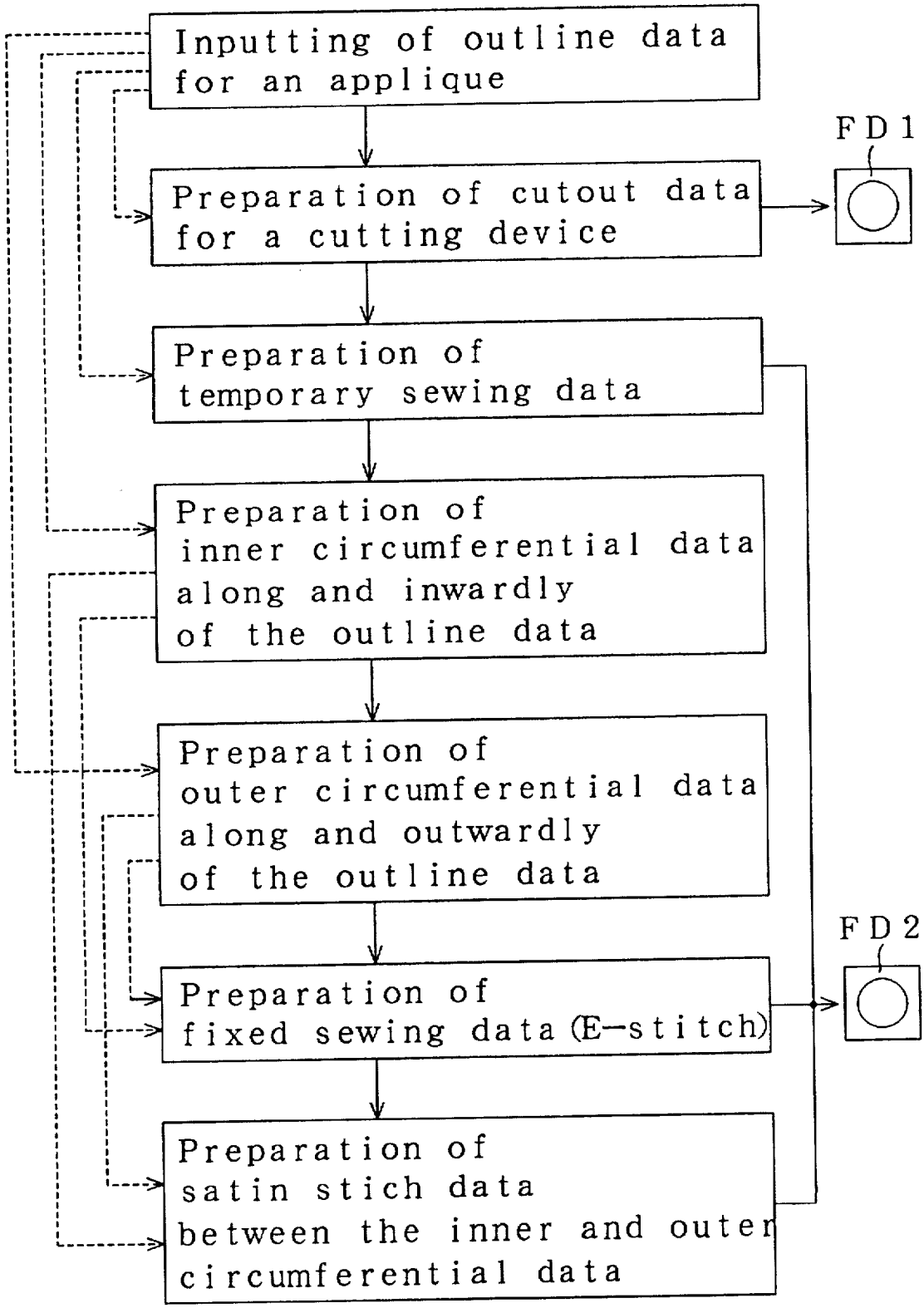
FIG. 2 is a flow chart showing a process embodying this invention.
Figure 3A:
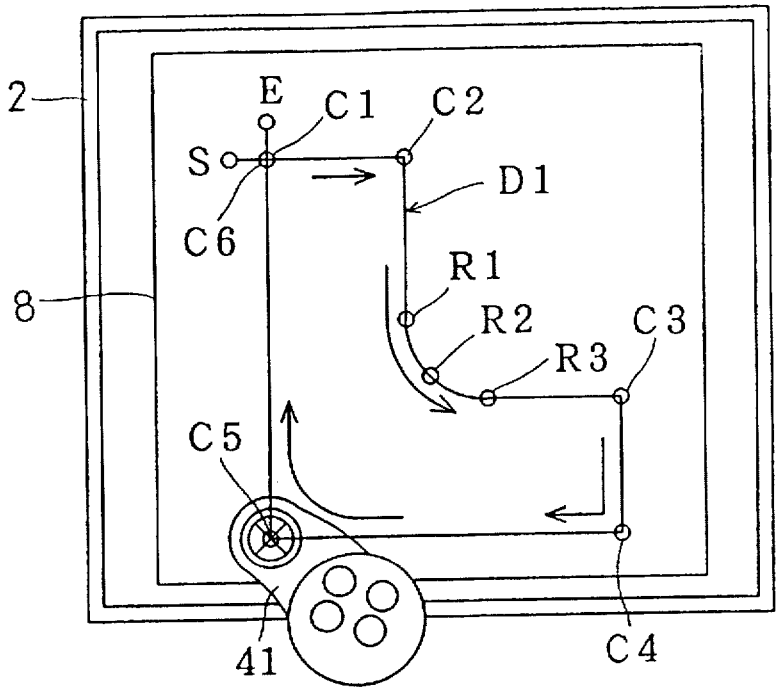
FIG. 3(*a*) is a view illustrating the step of inputting outline data, and FIG. 3(*b*) is a front elevational view of a display presenting information during the step shown in FIG. 3(*a*)
Figure 3B:
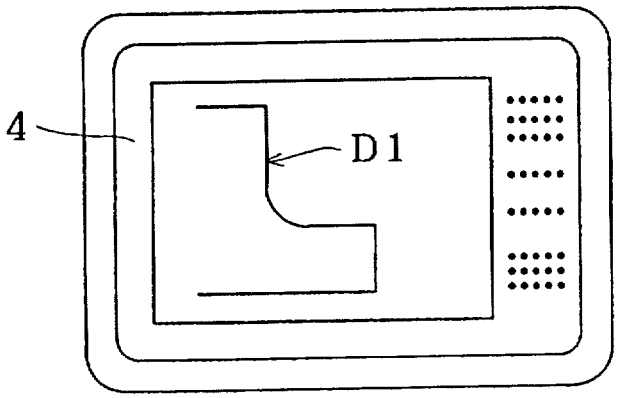

The preparation of the cutout and embroidery data by a process embodying this invention and employing the apparatus as shown in FIG. 1 takes place in the order of the steps as shown in FIG. 2. Each of the broken arrow lines in FIG. 2 shows the flow of data. The following is a detailed description of each step:

(A) Inputting of Outline Data for an Applique:

A pattern 8 having, for example, an L-shaped design is stuck to the board of the digitizer 2. Then, the corner points C1 to C6 and arc-forming points R1 to R3 which form its L-shaped outline are picked up by a pointing device 41, such as a button cursor or a stylus pen, as shown in FIG. 3(*a*), whereby outline data D1 are inputted only once. As the points are picked up one after another, a line connecting them appears on the display 4, as shown in FIG. 3(*b*).

When the outline data D1 are inputted, it is preferable to pick up a point somewhat ahead of the first corner point C1 as a starting point S and a point somewhat beyond the last corner point C6 (equal to C1) as an ending point E, so that cutout data may have a starting portion and an ending portion crossing each other and thereby ensure that no outline portion remain uncut.

Figure 4:
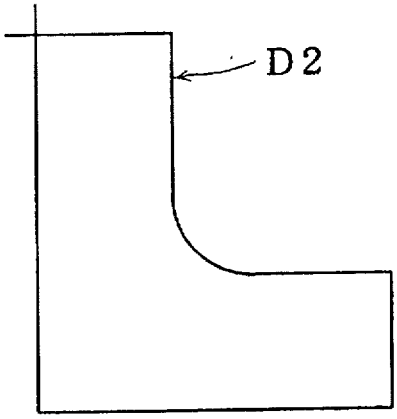
FIG. 4 is a view illustrating cutout data as prepared.

(B) Automatic Preparation of Cutout Data:

The control device 1 automatically prepares cutout data D2 represented by an L-shaped line, as shown in FIG. 4, from the outline data D1, and the floppy disk unit 6 stores the cutout data D2 in the floppy disk FD1.

Figure 5:
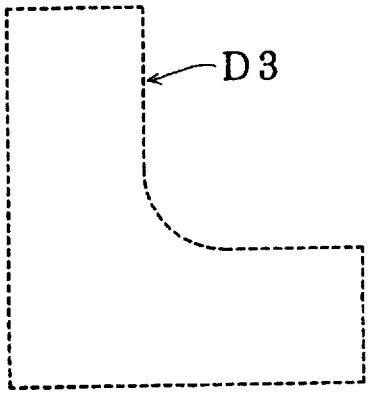
FIG. 5 is a view illustrating temporary sewing data as prepared.

(C) Automatic Preparation of Embroidery Data:

(1) The control device 1 automatically prepares, from the outline data D1, temporary sewing data D3 which are represented by an L-shaped line, as shown in FIG. 5, and which are required for positioning the applique on a piece of cloth. The floppy disk unit 6 stores the temporary sewing data D3 in the floppy disk FD2.

Figure 6:
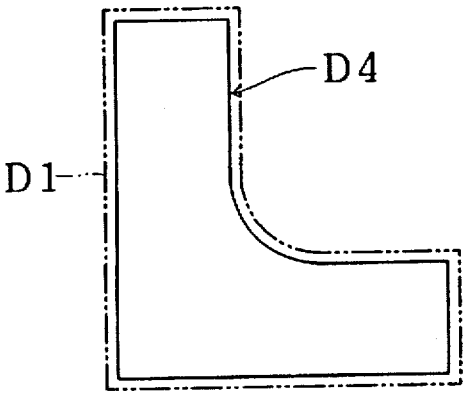
FIG. 6 is a view illustrating inner circumferential data as prepared.

(2) Then, the control device 1 automatically prepares, from the outline data D1, inner circumferential data D4 represented by an L-shaped line extending along and inwardly of the L-shaped line representing the outline data D1, as shown in FIG. 6.

Figure 7:
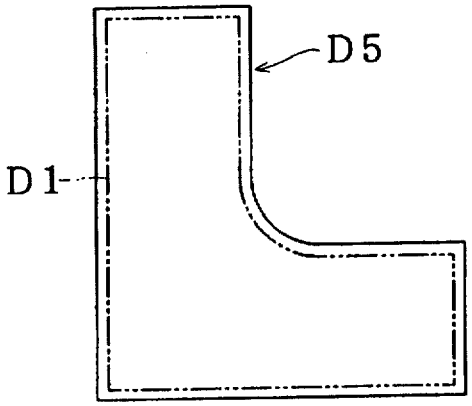
FIG. 7 is a view illustrating outer circumferential data as prepared.

(3) Then, the control device 1 automatically prepares, from the outline data D1, outer circumferential data D5 represented by another L-shaped line extending along and outwardly of the L-shaped line representing the outline data D1, as shown in FIG. 7.

Figure 8:
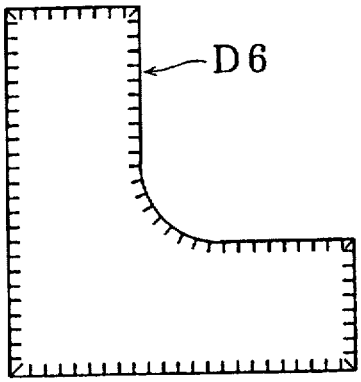
FIG. 8 is a view illustrating fixed sewing data as prepared.
Figure 9:
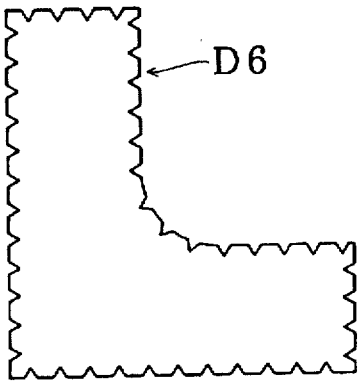
FIG. 9 is a view illustrating different form of fixed sewing data.

(4) Then, the control device 1 automatically prepares, from the inner and outer circumferential data D4 and D5, fixed sewing data D6 which are represented by an L-shaped line, as shown in FIG. 8, and which are required for fixing the applique. The data D6 are E-stitch data based on information on the direction and number of E-stitches as inputted to the control device 1 by the keyboard 3. The fixed sewing data D6 are, however, not limited to E-stitches, but may also be prepared to define a different form of stitches as shown in FIG. 9. The floppy disk unit 6 stores the fixed sewing data D6 in the floppy disk FD2.

Figure 10:
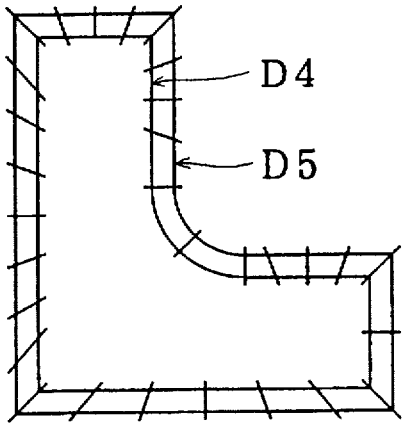
FIG. 10 is a view illustrating a mode of dividing an area defined by the inner and outer circumferential data.
Figure 11:
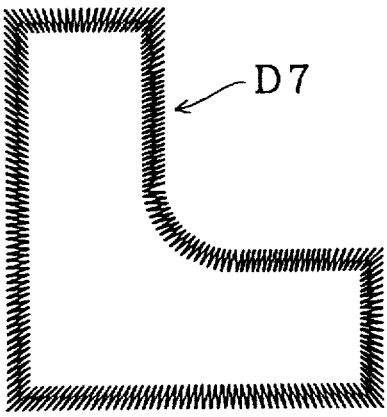
FIG. 11 is a view illustrating satin stitch data as prepared.

(5) Then, the control device 1 prepares, from the inner and outer circumferential data D4 and D5, satin stitch data D7 for embroidering the applique to another piece of cloth, as shown in FIG. 11. The control device 1 is so programmed as to divide a strip-shaped area between the lines representing the inner and outer circumferential data D4 and D5, as shown in FIG. 10, and to vary the directions of stitches to some extent from one portion of the area to another, so that the satin stitch data D7 may present a beautiful figure having no overlapping stitches at any corner. The floppy disk unit 6 stores the satin stitch data D7 in the floppy disk FD2.

Thus, the cutout data D2 are stored in the floppy disk FD1, and three kinds of embroidery data, the temporary sewing, fixed sewing and satin stitch data D3, D6 and D7, are stored in the floppy disk FD2.

The floppy disk FD1 is put in the floppy disk unit 14 of the cutting device 10, and the cutting device 10 is operated to cut out an L-shaped applique 42 in accordance with the cutout data D2. The floppy disk FD2 is put in the floppy disk unit 34 of the embroidering machine 20, and the embroidering machine 20 is operated to make an L-shaped temporary stitch on the cloth 23 in accordance with the temporary sewing data D3. After the applique 42 is stuck by e.g. an adhesive to the cloth 23 along the temporary stitch, the embroidering machine 20 is operated again to fix the applique 42 to the cloth 23 in accordance with the fixed sewing data D6. Then, the embroidering machine 20 is so operated as to embroider the applique 42 to the cloth 23 in accordance with the satin stitch data D7.

As many apparently widely different embodiments of this invention may be made without departing from the spirit and scope thereof, it is to be understood that the invention is not limited to the specific embodiments thereof except as defined in the appended claims.

What is claimed is:

1. A process for preparing data for cutting out an applique and embroidering it, comprising the steps of:

inputting data on an outline of said applique only once;

preparing data for cutting out said applique with a cutting device based upon said data on said outline; and preparing data for embroidering said applique with an embroidering machine based upon said data on said outline.

2. A process as set forth in claim 1, wherein said inputting is carried out by using a pointing device and picking up a plurality of points along the outline of a pattern attached to a digitizer.

3. A process as set forth in claim 2, wherein said picking up is started at a point generally ahead of a reference point selected arbitrarily from said points along said outline of said pattern, and is ended at a point generally beyond said reference point, so that said data for cutting out said applique may include a starting portion and an ending portion which cross each other.

4. A process as set forth in claim 1, wherein said inputting is carried out by using an image scanner and reading out the outline of a pattern.

5. A process as set forth in claim 1, wherein said data for embroidering said applique includes temporary sewing data for positioning said applique on a piece of cloth.

6. A process as set forth in claim 1, wherein said data for embroidering said applique include fixed sewing data for fixing said applique to a piece of cloth.

7. A process as set forth in claim 6, wherein said fixed sewing data are prepared from inner and outer circumferential data which are prepared from said inputted outline data, and which are represented by a line extending along and inwardly of a line representing said inputted outline data and a line extending along and outwardly of said line representing said inputted outline data, respectively.

8. A process as set forth in claim 1, wherein said data for embroidering said applique includes satin stitch data for embroidering said applique to a piece of cloth.

9. A process as set forth in claim 8, wherein said satin stitch data are prepared from inner and outer circumferential data which are prepared from said inputted outline data, and which are represented by a line extending along and inwardly of a line representing said inputted outline data and a line extending along and outwardly of said line representing said inputted outline data, respectively.

10. A process as set forth in claim 1, wherein said data for embroidering said applique include temporary sewing data for positioning said applique on a piece of cloth, fixed sewing data for fixing said applique to said cloth and satin stitch data for embroidering said applique to said cloth.

11. A process as set forth in claim 1, further including the step of storing at least one of said data for cutting out said applique and said data for embroidering it in an external memory.

12. A process as set forth in claim 1, further including the step of transmitting at least one of said data for cutting out said applique and said data for embroidering it directly to a cutting device or an embroidering machine.

13. An apparatus for preparing data for cutting out an applique and embroidering it, comprising:

means for inputting data on the outline of said applique in a single data acquisition step; and means for preparing, from said data acquired in said single data acquisition step, both data for cutting out said applique and data for embroidering it.

14. An apparatus as set forth in claim 13, wherein said inputting means comprises a digitizer and a pointing device.

15. An apparatus as set forth in claim 13, wherein said inputting means comprises an image scanner.

16. An apparatus as set forth in claim 13, wherein said data preparing means comprises a microcomputer.

17. An apparatus as set forth in claim 13, further including an external memory for storing at least one of said data for cutting out said applique and said data for embroidering it.

18. An apparatus as set forth in claim 13, further including means for transmitting at least one of said data for cutting out said applique and said data for embroidering it directly to a cutting device or an embroidering machine.

19. An apparatus as set forth in claim 18, wherein said transmitting means comprises a transmission cable.

20. An apparatus as set forth in claim 18, wherein said transmitting means comprises a wireless transmission device.

21. A process for cutting out an applique and embroidering it, comprising the steps of:

providing a pattern having a predetermined outline;

performing a single data inputting step to derive data based on said predetermined outline;

cutting out said applique from a larger piece of material based on said data derived in said single data inputting step; and embroidering said applique based on said data derived in said single data inputting step.

22. A device for cutting out an applique and embroidering it, comprising:

means for deriving data based on a pattern having a predetermined outline in a single data inputting step;

means for cutting out said applique from a larger piece of material based on said data derived in said single data inputting step; and means for embroidering said applique based on said data derived in said single data inputting step.

* * * * *